United States Patent [19]

Kohanawa et al.

[11] Patent Number: 4,635,012

[45] Date of Patent: Jan. 6, 1987

[54] CONTACTOR STRUCTURE OF CIRCUIT BREAKER

[75] Inventors: Akihiko Kohanawa, Fukiage; Kiyoshi Kandatsu, Okabe, both of Japan

[73] Assignee: Fuji Electric Co., Ltd., Kawasaki, Japan

[21] Appl. No.: 763,814

[22] Filed: Aug. 8, 1985

[30] Foreign Application Priority Data

Aug. 10, 1984 [JP] Japan ..... 59-168039

[51] Int. Cl.[4] ..... H01H 75/00; H01H 77/00; H01H 83/00

[52] U.S. Cl. ..... 335/16; 335/147; 335/195; 335/190; 335/189; 335/194; 200/147 R; 403/157

[58] Field of Search ..... 335/16, 195, 147, 192, 335/190, 189, 194; 200/147 R; 403/157, 158, 159

[56] References Cited

U.S. PATENT DOCUMENTS 4,190,378 2/1980 Stecklein ..... 403/159
4,255,636 3/1981 Wafer ..... 335/195

*Primary Examiner*—E. A. Goldberg
*Assistant Examiner*—Lincoln D. Donovan
*Attorney, Agent, or Firm*—Brumbaugh, Graves, Donohue & Raymond

[57] ABSTRACT

Individual movable contactors of a circuit breaker are made up of a pair of conductors. The first conductor has one end bifurcated to form a pair of legs separated by a slit. At the open end each leg has a curved inner portion the opposed curved portions of the two legs defining a receptor space which is substantially circular in cross section. The second conductor has one end whose cross section is substantially circular and which fits within the receptor space and makes a good slidable contact therewith, and the other end which supports the main contact. Provision is made for rotating the second conductor about its circular end for opening or closing connection to the main contact.

4 Claims, 8 Drawing Figures

CONTACTOR STRUCTURE OF CIRCUIT BREAKER

FIELD OF INVENTION

The present invention relates to the structure of the contactor of circuit breaker, wherein said contractor is fixed to a holder which is pivoted and sways so that a movable contact makes contact with or separates from a fixed contact.

BACKGROUND OF THE INVENTION

If a short-circuit trouble occurs in the branching circuit of power distribution system, in order to avoid the power failure of entire power distribution system, it is important to quickly cut off the circuit breaker inserted to such branching circuit and thereby to keep the condition of the circuit breaker in the main circuit closed for a short period of time against a short-circuit. However, in this case, it is required that the contactor structure of the circuit breaker have sufficient capacity so that the temperature rise is controlled. FIG. 6 shows an example of circuit breaker of the prior art and FIG. 7 shows a structure of the movable contactor thereof. In the figures, the one end of movable contactor piece holder 1 is supported by an axis pin 3 to a case accommodating such circuit breaker and the holder is swayed through a toggle device 5 by moving handle 4 to the right or left. 6 is an operation spring attached to the handle 4. The movable contactor piece 7 is mounted to a coupling pin 8 between the side walls of holder 1 and the main movable contact 9 is fixed to the one end. When the holder 1 sways, such main contact is in contact with or separated from the fixed contact of the fixed contactor 10 to be connected to the side of power supply. A connecting conductor 11 which is flexible in its thickness direction and is composed of laminated thin copper plates is connected to the other end of movable contactor piece 7 and is then connected to a load through an over current detecting circuit not shown. The movable contactor piece 7 is divided into two segments as shown in FIG. 7 in order to ensure the contact of main movable contact 9. Therefore, the connecting conductor 11 is provided with the slit 11*a* in the side to be connected to two movable contactor pieces 7. 12 is an arc movable contactor fitted between two movable contactor pieces 7 and a contact spring 13 is respectively attached respectively between the movable contactor piece 7 or arc movable contactor piece 12 and holder 1. A lever 14 is engaged with the latch 15 in the side of over current detector as shown in FIG. 6. But when an over current flows, the latch 15 is disengaged, the toggle device 5 crumbles and thereby the movable contactor piece 7 separates from the fixed contactor 10.

This circuit breaker ensures easy sway of movable contactor, endures many times of opening and closing operations and allows a heavy current to flow. The connecting conductor connected to the movable contactor piece is formed by stacking many thin copper plates and is flexible in the thickness direction. Moreover, such movable contactor piece is long (L) and thereby total length of circuit breaker becomes long. When many movable contactor pieces are supported between holders in order to ensure a high current capacity, the main movable contact and the fixed contact are respectively in contact individually. Therefore, such method is effective for suppressing temperature rise of contact and reducing an electromagnetic repulsion force. But, it also results in the disadvantage that it is required to provide many slits to the connecting conductor and thereby the circuit breaker becomes expensive.

Thus, the structure of contactor as shown in FIG. 8 has also been proposed. The movable contactor piece 7 is provided by a coupling pin 8 and axis pin 3 between the side walls of holder 1 which is swayed by a handle 4 through a toggle device 5 as in the case of that shown in FIG. 6 and it sways together with the holder 1. Thereby, it is in contact or separated form the contact of fixed contactor 10. This movable contactor piece 7 is provided with protruded area 7*a* like an arc at the other end of the same surface as the main movable contact 9 fixed at the one end thereof and is slidable in contact with at recess 11*b* like an arc provided to the connecting conductor 11. Accordingly, a simple structure is possible for the connecting conductor. However, since the movable contactor piece is movable supported with an axis pin 3 by an elongated axis hole, when a current I flows to the connecting conductor 11 from the movable contact piece 7 as indicated by an arrow mark of solid line, an electromagnetic repulsion force F—F as indicated by an arrow mark of dotted line is generated between the protrusion 7*a* and recess 11*b*, resulting in poor contact. Therefore a compression spring 16 is used for obtaining sufficient contact between them. But since a repulsion force F—F between them is proportional to a square value of current I, when a heavy current such as a short-circuit flows, the repulsion force F—F becomes very large and a compression force of spring 16 must usually be intensified. As a result, a large friction force is generated at the time of usual opening or closing. This is a disadvantage for the opening and closing operations.

It is an object of the present invention to provide a contactor structure of a small size for use in an economical circuit breaker which eliminate the discussed disadvantages of the prior art and has a large single-time current rating.

To this end, the invention is a contactor structure from a circuit breaker which includes a first conductive connecting member which remains fixed and a second conductive member which sways with respect to the fixed member whereby the main contact on the second member makes or breaks connection with a fixed contact. The first member has one end bifurcated to form a pair of legs each of whose free end has an arc-like inner surface in cross section and the two arc-like surfaces define between them a substantially circular receptor space. The second member has the movable main contact at one end and at the other end a contact region which is substantially circular in cross section and this end is enclosed within the receptor space and makes sliding contact with the arc-like surfaces as the second member is swayed with respect to the first member. The second member is rigidly coupled to the holder which can be toggled to make or break the contact.

BRIEF DESCRIPTION OF THE DRAWINGS

FIGS. 1–5 are different views of an embodiment of the invention of which FIG. 1 is a side elevation and FIG. 2 a plan view of the assembled contactor structure, FIGS. 3 and 4 are side elevations of the movable contactor member and the fixed contactor member, respectively, and FIG. 5 is a diagram indicating the electromagnetic forces in the connecting area between the members shown in FIGS. 3 and 4.

DETAILED DESCRIPTION OF THE INVENTION

Figure 1:
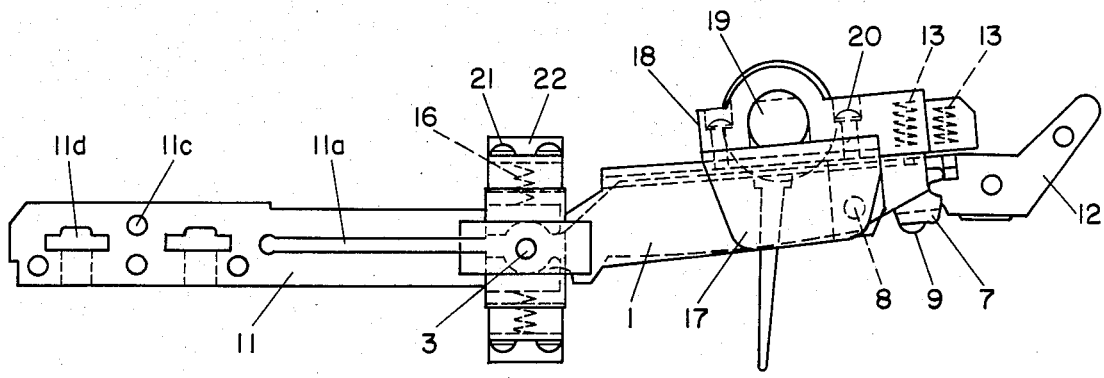
Figure 2:
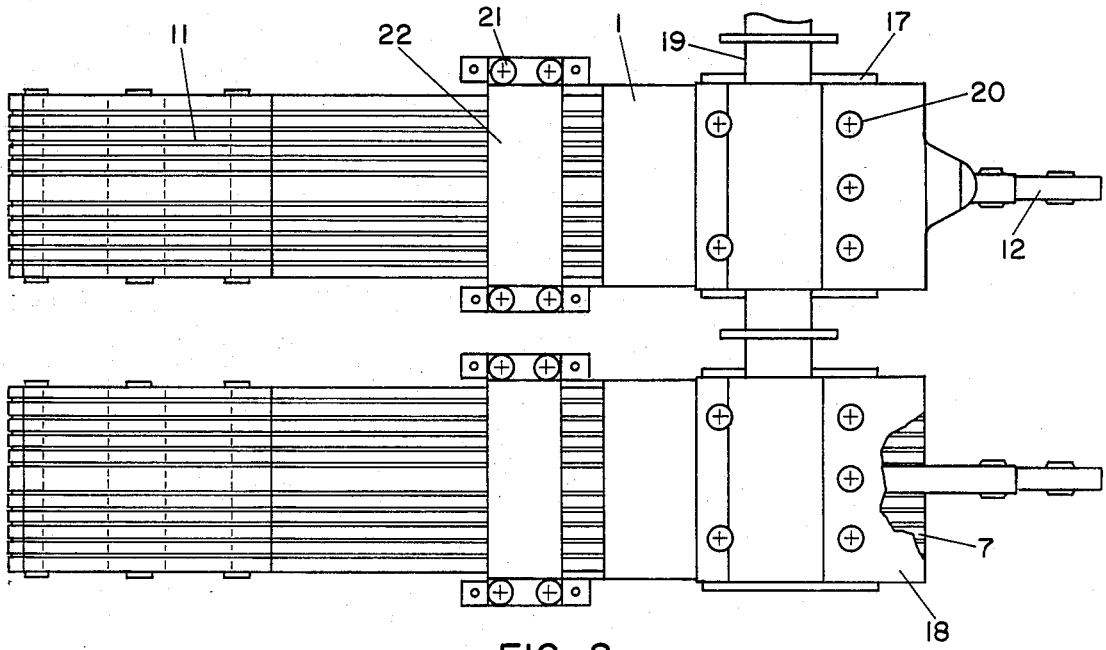
Figure 3:
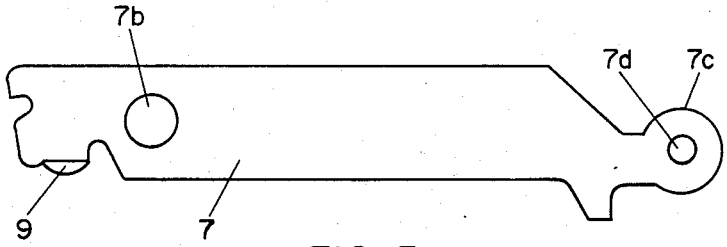
Figure 4:
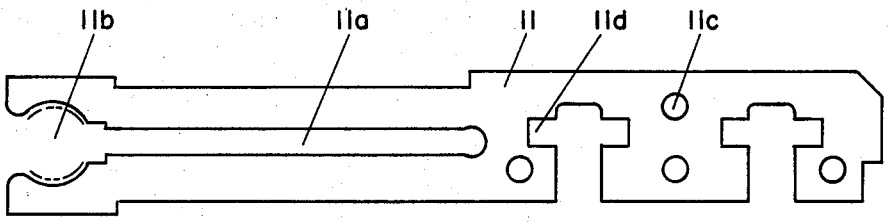
Figure 5:
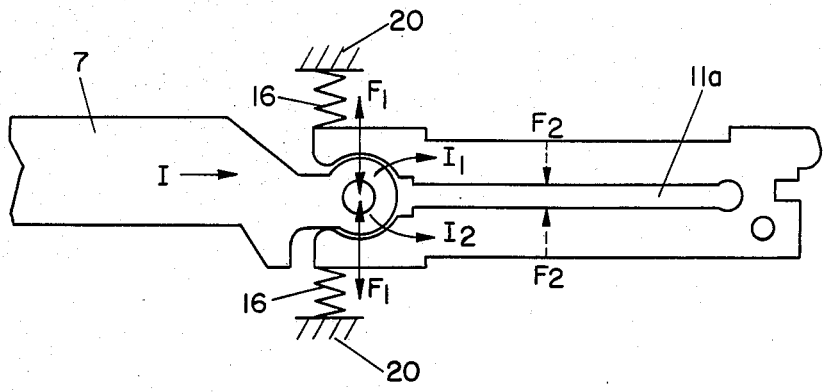
Figure 6:
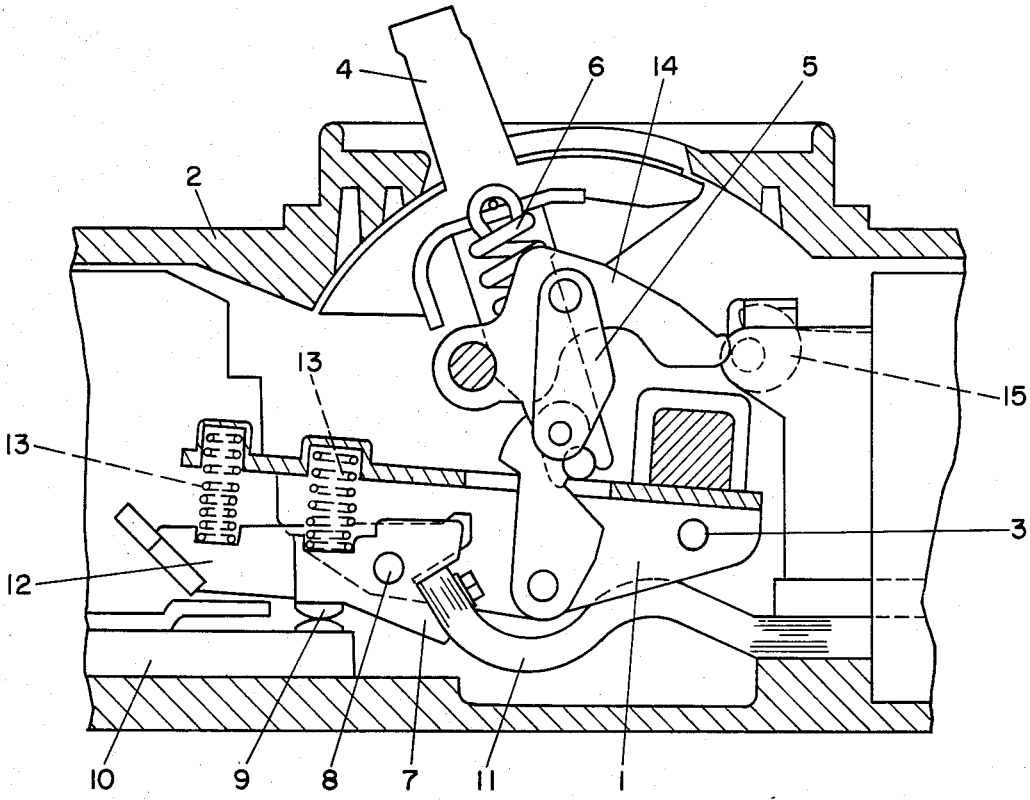
FIG. 6 PRIOR ART
FIG. 6 is a cross section of a side elevation of a prior art circuit breaker.
Figure 7:
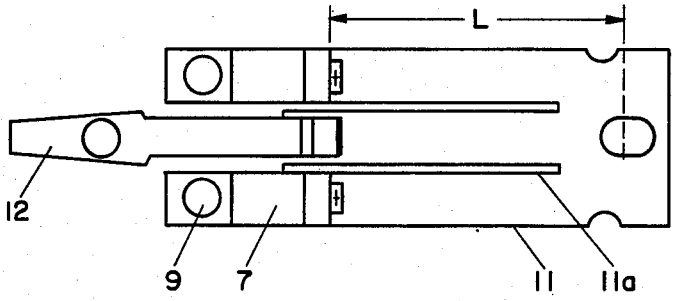
FIG. 7 PRIOR ART
FIG. 7 is a plan view of the contactor structure in the circuit breaker shown in FIG. 6.
Figure 8:
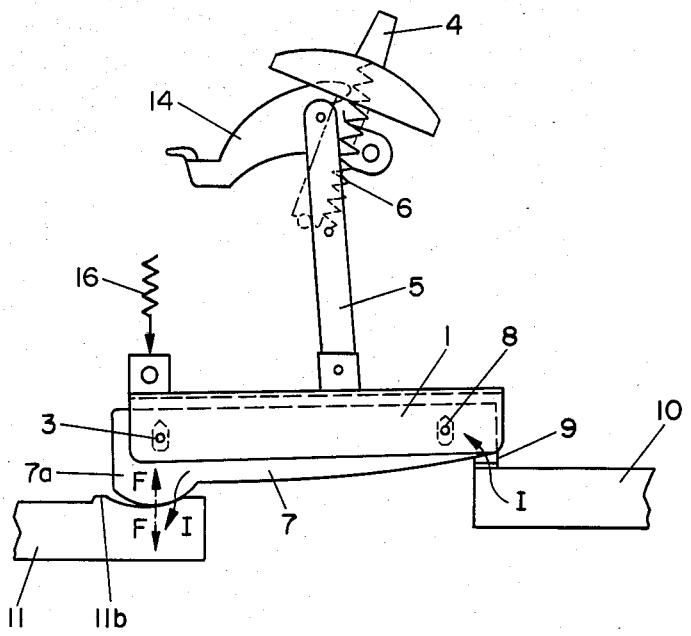
FIG. 8 PRIOR ART
FIG. 8 is a side elevation of a different prior art movable contactor.

An embodiment of the present invention is described in detail by referring to FIG. 1 to FIG. 5. As seen in FIG. 1 and FIG. 2, the movable contactor member 7 is roughly rectangular and has a combining hole 7*b*, as shown in FIG. 3. One end thereof is provided with the main movable contact 9, while the other end is provided with almost circular contact surface 7*c*. The center thereof has an axis hole 7*d*. A plurality of similar movable contactor members are arranged between the side walls of holder 21, and the coupling pin 8 is caused to run through the coupling holes 7*b*, and the axis pin 3 is also caused to run through the axis hole 7*d* to provide coupling between the plurality. The arc-like contactors 12 are located near the center of these plurality of movable contactor members 7. Outside holder 21, an insulating barrier 17 is attached to cover the outside of holder 21. The opening and closing arm 19 is held by the holder 21 where the movable contactor members are arranged and insulated by the insulation barrier 17 and the holder support 18 and such movable contactor pieces are coupled to the opening and closing arm 19 through the tightening by insulation screws 20. The connecting conductors 11 which are connected to respective movable contactor pieces 7 are essentially rectangular as shown in FIG. 4. The slit 11*a* extends in the longitudinal direction from the one end, bifurcating the end to form the upper and lower legs and is shaped to form the receptor surfaces 11*b* which are opposed arc-like regions in the two legs at the open end of the two legs. At the other end, a coupling hole 11*c* for connection and a cut-away part 11*d* for mounting necessary members are provided. The sliding contact surface 7*c* of movable contactor piece 7 engages the receptor surfaces 11*b* of its associated connecting conductor 11, contact pressure is maintained by the compression spring 16 from the rear side of the connecting conductor 11 and thereby perfect contact can be obtained between the receptor surface 11*b* and contact surface area 7. 21 is a tightening screw for clamping member 22 for compression spring 16.

This movable contactor 9 is moved by means of the toggle device (not shown) by opening and closing arm 19. This contactor swings about the axis pin 3 as the fulcrum in the usual fashion so that it is in contact with or separated from the fixed contactor (not shown). An over-current is also cut off in the usual fashion and therefore it is not explained here.

When this circuit breaker is connected to the circuit and is turned ON, the path of current I flow is movable contactor piece 7—connecting conductor 1—and the load (not shown), through the fixed contactor and main movable contact 9. In this case, an electromagnetic repulsion force $F_1$—$F_1$ indicated by the solid arrows is generated between the sliding contact surface 7*c* of movable contactor piece 7 and the receptor 11*b* of connecting conductor 11. However, since the current I is divided into ½ equally by the two legs of connecting conductor 11, an electromagnetic attracting force $F_2$—$F_2$ indicated by the broken line arrows is generated between such legs. By appropriate design the repulsion force $F_1$—$F_1$ and the attracting force $F_2$—$F_2$ cancel each other, normal contact pressure between the contactor 7*c* and receptor 11*b* is maintained by the compression spring 16. Therefore, if a current I is a heavy current like a short-circuit current, the compression spring 16 is not required to have a force larger than that providing the normal contact pressure. Accordingly, the friction force between the contact surface and receptor surface is always small and ON-OFF operation can be realized with an operating force smaller than in prior art forms.

For a circuit breaker having a small current capacity, the number of movable contact pieces can be reduced in order to widen the separation. Thereby, cooling characteristic can be improved and a comparatively heavy current can be applied thereto. The movable contactor pieces and connecting conductors can be manufactured easily and are just suited to mass-production by punching a conductive thins plate, of such thickness as can be punched by a press, into the required shape.

As described above, contactor of the circuit breaker of the present invention has a structure in which a connecting conductor is bifurcated into two legs by providing the slit in its longitudinal direction, and the arc-like receptor surfaces slidably suppoort the circular sliding contact surface of one end of a movable contactor. As a result a current flowing into the movable contactor piece from the fixed contactor is divided between the two legs in this connecting conductor. Since the currents in the two legs flow in the same direction, an electromagnetic attracting force is generated between them and this attracting force cancels the electromagnetic repulsion force generated between the sliding contact surface and connecting conductor. Accordingly, the contact pressure between the movable contactor piece and connecting conductor can be kept almost constant whether a normal current flows or a heavy current flows. As a result, the compression spring need have only a comparatively weak spring force. Therefor, the friction force between them can be reduced to a small value and the device can be made small in size. Moreover, the movable contactor piece is coupled almost coaxially with the connecting conductor and is supported by the axis pin, thereby enduring smooth swaying operation. Additionally the contact resistance between movable contactor piece and the connecting conductor is stabilized to a small value, resulting in only a small temperature rise. Excellent contact can be obtained between both contactors and electromagnetic repulsion force between them is also reduced. Temperature rise due to poor contact of contacts can be reduced by arranging many movable contactor pieces in parallel and causing the main movable contacts to individually make contact with the contacts of the fixed contactor. In addition, the geometries of both the movable contactor piece and connecting conductor facilitate mass-production because these can be formed easily by punching a thin plate. As explained above, the present invention provides contactor of small size and economical circuit breaker which is resistive to thermal and mechanical stress while a heavy current flows for a short period of time.

We claim:

1. In a circuit breaker, a contactor structure comprising a first stationary conductive connection member one of whose ends is bifurcated to define a pair of legs, each of whose free end has an arc-like surface defining therebetween a substantially circular receptor space, and, a second conductive member including at one end the main movable contact for opening or closing a connection to a fixed contact and at the other end a contact region which is substantially circular in cross section and is enclosed within the receptor space for making sliding contact with the enclosing arc-like surfaces of the first member, and means for rotating said second member with respect to said first member for opening or closing the connection with the fixed contact.

2. A contactor structure as in claim 1 in which an axis pin passes through an opening in the center of the circular end of the second member and serves as the fulcrum about which the second member pivots.

3. A contactor structure in accordance with claim 1 in which the first and second members each comprise a plurality of parallel conductive elements.

4. A contactor structure in accordance with claim 1 including spring means for maintaining contact pressure on the two arc-like surfaces of the first member against the substantially circular enclosed contact region of the second member.

* * * * *